US005803367A

United States Patent [19]

Heard et al.

[11] Patent Number: 5,803,367

[45] Date of Patent: Sep. 8, 1998

[54] SPRAY GUN

[75] Inventors: Tony Heard; Andrew Edge; Anthony John Bate; Rowland Charles Smith, all of Dorset; Neville Thomas Pettit, Lymington, all of United Kingdom

[73] Assignee: ITW Limited, United Kingdom

[21] Appl. No.: 682,777

[22] PCT Filed: Feb. 10, 1995

[86] PCT No.: PCT/GB95/00275

§ 371 Date: Jul. 30, 1996

§ 102(e) Date: Jul. 30, 1996

[87] PCT Pub. No.: WO95/22409

PCT Pub. Date: Aug. 24, 1995

[30] Foreign Application Priority Data

Feb. 18, 1994 [GB] United Kingdom ..... 9403110
Dec. 8, 1994 [GB] United Kingdom ..... 9424821

[51] Int. Cl.[6] ..... B05B 7/02

[52] U.S. Cl. ..... 239/296; 239/340

[58] Field of Search ..... 239/525, 526, 239/290–296, 340, 354

[56] References Cited

U.S. PATENT DOCUMENTS

| | | | |
|---|---|---|---|
| 2,104,761 | 1/1938 | Richter | 239/290 X |
| 3,515,355 | 6/1970 | Wagner | 239/526 |
| 4,022,381 | 5/1977 | Karliner | 239/526 X |
| 4,502,629 | 3/1985 | MaGhee et al. | 239/296 X |
| 4,537,357 | 8/1985 | Culbertson et al. | 239/600 X |
| 4,679,734 | 7/1987 | Mommsen et al. | 239/694 X |
| 5,090,623 | 2/1992 | Burns et al. | 239/301 |
| 5,169,070 | 12/1992 | Mattson | 239/290 |
| 5,328,601 | 7/1994 | Schmidt et al. | 210/137 |

FOREIGN PATENT DOCUMENTS

| | | | |
|---|---|---|---|
| 510779 | 10/1930 | Germany | 239/296 |
| 916519 | 7/1954 | Germany | 239/296 |
| 1653851 | 6/1991 | U.S.S.R. | 239/296 |

*Primary Examiner*—Kevin Weldon
*Attorney, Agent, or Firm*—MacMillan, Sobanski & Todd

[57] ABSTRACT

An improved spray gun having an aluminum gun body and a sprayhead made of a plastics material, preferably of polybutylene terephthalate. The sprayhead is permanently secured to the spray gun body, preferably with a swaged ring of stainless steel. The spray gun may be provided with a plastic handle which is preferably formed from polybutylene with 10% of a polyester elastomer. In one embodiment, the sprayhead is oriented relative to the gun body prior to securing to select either gravity feed or suction feed for the sprayed fluid.

15 Claims, 11 Drawing Sheets

SPRAY GUN

BACKGROUND OF THE INVENTION

This invention relates to an improved spray gun which is light-weight and has an improved air control flow distribution to the spray nozzle.

In conventional high pressure spray guns, it is normal to increase or reduce the pressure at the horn-section of the aircap to change the spray pattern size and as a consequence the pressure in the atomizing air section at the centre of the aircap is automatically raised or lowered. To maintain this pressure relatively constant, two separate air supplies to the spray nozzle have to be regulated, as the control of air pressure in one flow path affects the air pressure of the other flow path.

To reduce atmospheric pollution, new legal requirements are in the course of implementation to restrict the air pressure in this atomising section of the aircap to 10 psi (0.7 bar).

In the applicant's GB Patent No. 2247193 there is described and claimed a spraygun comprising a body having an axis and a nozzle having a fluid orifice for discharging a fluid jet and an air cap attached to the front of the body, the air cap defining an annular orifice about the fluid nozzle for discharging atomisation air and including a pair of horns each having an orifice for discharging spreader air, means for delivering a relatively high volume flow of low pressure air to the spray gun, a baffle positioned between the barrel and the air cap, the baffle co-operating with the nozzle and the air cap to divide the delivered air between the atomisation air orifice and the spreader air orifices, a control ring positioned between the baffle and the body for rotation about an axis parallel to the body air, the control ring having a first position wherein the flow of such delivered air through the baffle to the atomisation air and spreader air orifices is unimpeded and a second position wherein the control ring obstructs the flow of the delivered air through the baffle to the spreader air orifices and wherein the nozzle includes a threaded end attached to the body to retain the baffle and the control ring on the body.

Hitherto, this problem of air flow pressure has been controlled by regulating the air pressure of the supply to the spray gun.

Another disadvantage with existing spray guns is that they are principally manufactured from metals such as aluminum, stainless steel and brass which are durable and resistant to the material, e.g., paint, being sprayed, but are relatively heavy and after continued use cause fatigue to the user. To overcome this disadvantage, it is proposed to lighten the weight of such spray guns by moulding parts of the body and handle in a light weight synthetic resinous material which is inert to the fluids to be sprayed by the gun, e.g. paint.

SUMMARY OF THE INVENTION

An aim of the present invention is to provide an improved spray gun which overcomes or mitigates the above disadvantages.

According to the present invention there is provided a spray gun comprising a diecast aluminum body, a sprayhead, nozzle and a handle made of a plastics material wherein the sprayhead is permanently joined to the body by a metal ring swaged to the gun body and the sprayhead.

Preferably the metal ring is made of stainless steel.

Conveniently, the handle is made of polybutylene teraphthalate with 10% of a polyester elastomer.

The plastics handle may include a coloured pigment to facilitate laster marking of the handle surface.

Preferably weirs are formed on a centre spine of the nozzle which co-operate with the sprayhead to baffle the flow of air through the gun.

In a preferred construction the spray gun comprises a body having a head and nozzle, weirs being formed in the head and the nozzle to baffle the flow of air through the gun to the assembly of an aircap wherein the weirs are formed by the relationship between the profile of the gun head and the external profile of the nozzle.

Preferably, the gun body is made of a die-cast aluminium and the head of a hard plastics material, the die-cast body being swaged over the outer profile of the head.

Conveniently a moulding of a relatively softer plastics material to the head is interposed between the gun head and die-cast body to form a labyrinth, and small beads of plastics material are moulded into its interengaging faces so that the beads are crushed during the swaging operating to seal the faces.

In a preferred construction, the gun head has a spigot which engages the die-cast body to form an inlet to be interconnected between the body and head for a gravity feed or suction/pressure feed of fluid.

Conveniently, the rear end of the spigot has a seal for a needle slidable in the spigot, the seal having a tapered projection projecting into a space for the fluid, a scraper seal being located in the fluid space to prevent ingress of the fluid to be sprayed.

Conveniently, the spray gun body includes an air valve having an acetal plastics body with a tapered seating at its rearward face, and a spring loaded stem to shut off the air when the valve stem is pushed forward by the spring. The valve stem may be made of stainless steel and is supported in a moulded-in bearing at the rear of the acetal plastics body, a polytetrafluorethylene (PTFE) bush being mounted in a bore at the front of a handle bore.

Preferably, the stem is lubricated by the transfer of PTFE during use.

Conveniently a seal is fitted into the front of the air valve body to prevent escape of air to the atmosphere when the gun is in operation.

Preferably, the gun handle is moulded from acetal resin reinforced by a tube moulded in the assembly which is attached to an air inlet connection.

In one preferred construction of the spray gun, it is an automatic spray gun, other than a hand held gun.

The spray gun may include an air distributor control valve comprising a fixed member having radial apertures and a rotatable member with radial apertures, axially aligned and rotatable relative to the fixed member, the valve being mounted in the path of two separate air supplies to an aircap via a spray head, the rotatable member being rotated to progressively shut the radial apertures to shut off shaping air to horns of the aircap while simultaneously reducing the flow of atomising the to centre of the aircap to maintain it at a constant pressure.

Preferably, the fixed and rotatable members are shaped as apertured plates located face to face in the body of a spray gun as hereinbefore defined.

Embodiments of the improved spray gun according to the present invention will now be described, by way of example only, with reference to the accompanying drawings:

DESCRIPTION OF THE PREFERRED EMBODIMENTS

Figure 1:
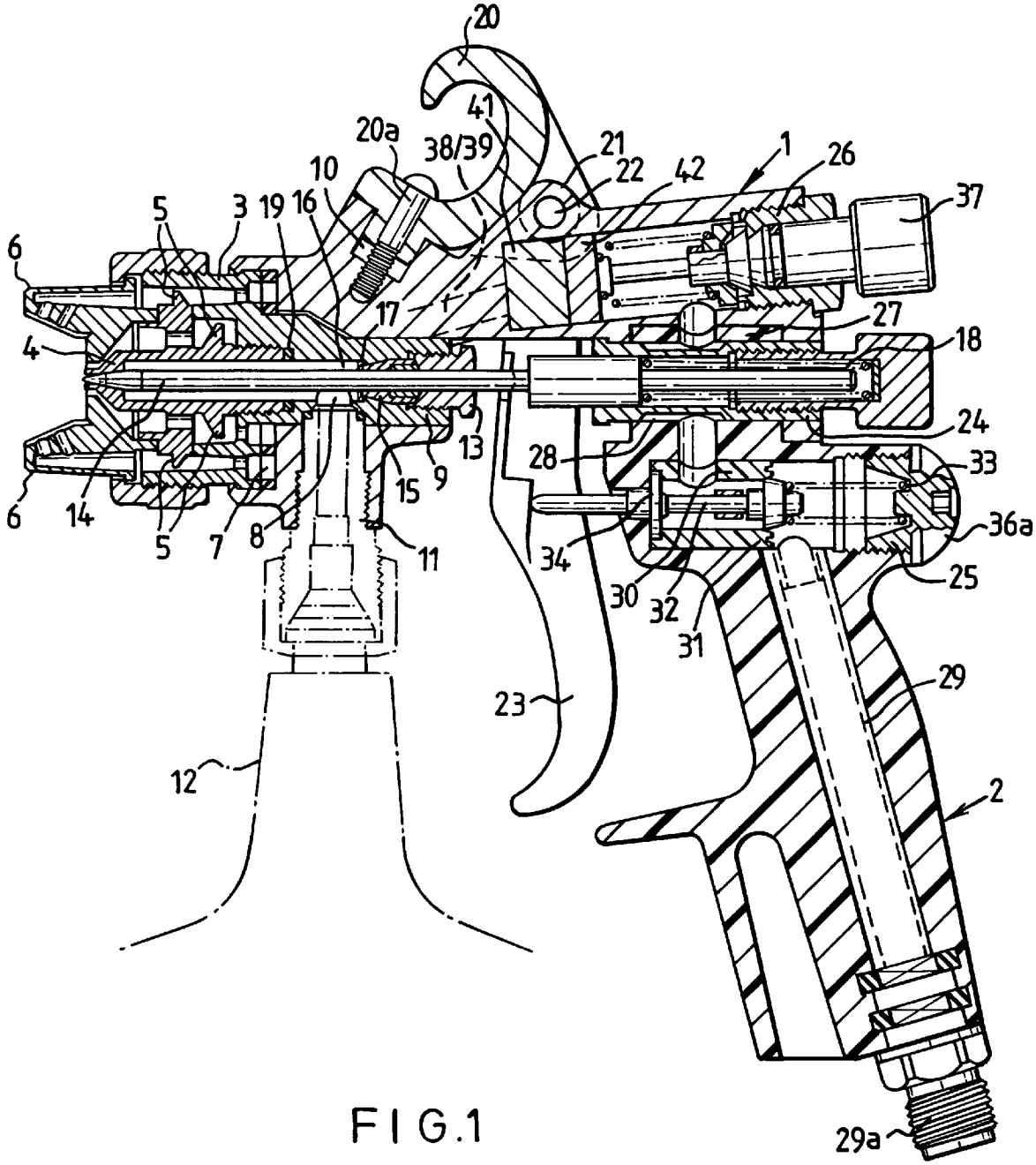
FIG. 1 is an axial cross-section of the improved spray gun, in suction or pressure configuration.

The improved hand held spray gun shown in FIG. 1 comprises a body 1 and a handle 2, the body including a head 3 and nozzle 4 with weirs 5 formed in the nozzle 4 to baffle the flow of air through the gun to the aircap. The design of the weirs 5 provides an efficient baffling of the flow of air giving an even distribution to both the central atomising air to nozzle 4 and the flow of spreader air to the outer horns 6 of the aircap.

The weirs 5 are created by the relationship of the profile of the gun head 3 and the external profile of the nozzle 4. The gun body 1 is made of a die-cast aluminum which is swaged over the outer profile of the head 3 which is made of a hard plastics material, e.g. polybutylene terephthalate, to provide an efficient mechanical joint and seal between the parts.

Interposed between the gun head and the die-cast body is a moulding 7 of a softer plastics material than that of the head, e.g. an acetal copolymer. This moulding 7 is formed as a labyrinth which has moulded into its faces small beads (not shown) which are crushed during the swaging operation to seal the engaging faces of the body and head.

The gun head 3 is spigotted into the die-cast body 1 so that the inlet 8 for fluid can be interconnected to the spigot 9 for either gravity feed through inlet 10 (see FIG. 2) or suction or pressure feed of the fluid through inlet 11 from a cup 12 which may be pressurised from an external source. At the rear end of the spigot 9 a seal 13 is fitted in which a needle 14 slides. This seal has a tapered projection 15 protruding into a fluid space 16 in which is located an internal scraper seal 17 to prevent ingress of the fluid, e.g. paint, to be sprayed. The needle 14 is adjusted from a spring loaded needle assembly 18 mounted in the gun body at the rear of the needle.

The nozzle 4 is a moulded component which is threaded into the gun head and is sealed by a U-shaped soft plastics seal 19. The base of the 'U' faces inwards to create a smooth junction between the nozzle 4 and the gun head passageways to reduce the possibility of paint traps forming and to facilitate ease of cleaning.

The nozzle is tightened by hand using a specially designed spanner (not shown) which is in the form of a disc with a knurled periphery. The spanner is located onto the front of the nozzle using a multi-faceted internal profile matching the external profile of the nozzle.

In the suction/pressure feed embodiment of the spray gun shown in FIG. 1, a hook 20, moulded from acetal plastics, is fitted to the gun, when assembled in a factory, by clipping the hook over the bosses 21, at either side of the gun body, through which a pivot 22 is located for a trigger 23. The ends of the pivot 22 may be retained by circlips. The hook 20 is prevented from rotation about the boss 21 by a bolt or screw 20*a*.

The handle 2 is secured to the gun body 1 by pressing together the handle and die-cast body and inserting into the assembly a stainless steel bushing 24 through which passes the needle assembly 18 and around which is formed a grooved recess which allows air to pass from an exit port of an air valve 25 up into an air distributor 26 in the top of the gun body.

The top of the handle 2 is formed into a rectangular section tongue 27 through which a hole 28 passes to accept the bushing 24. The handle is moulded from acetal plastics material and is reinforced by a tubular assembly 29 moulded into the handle and projecting from the base of the handle to which an outside air inlet connection 29*a* is attached.

Figure 2:
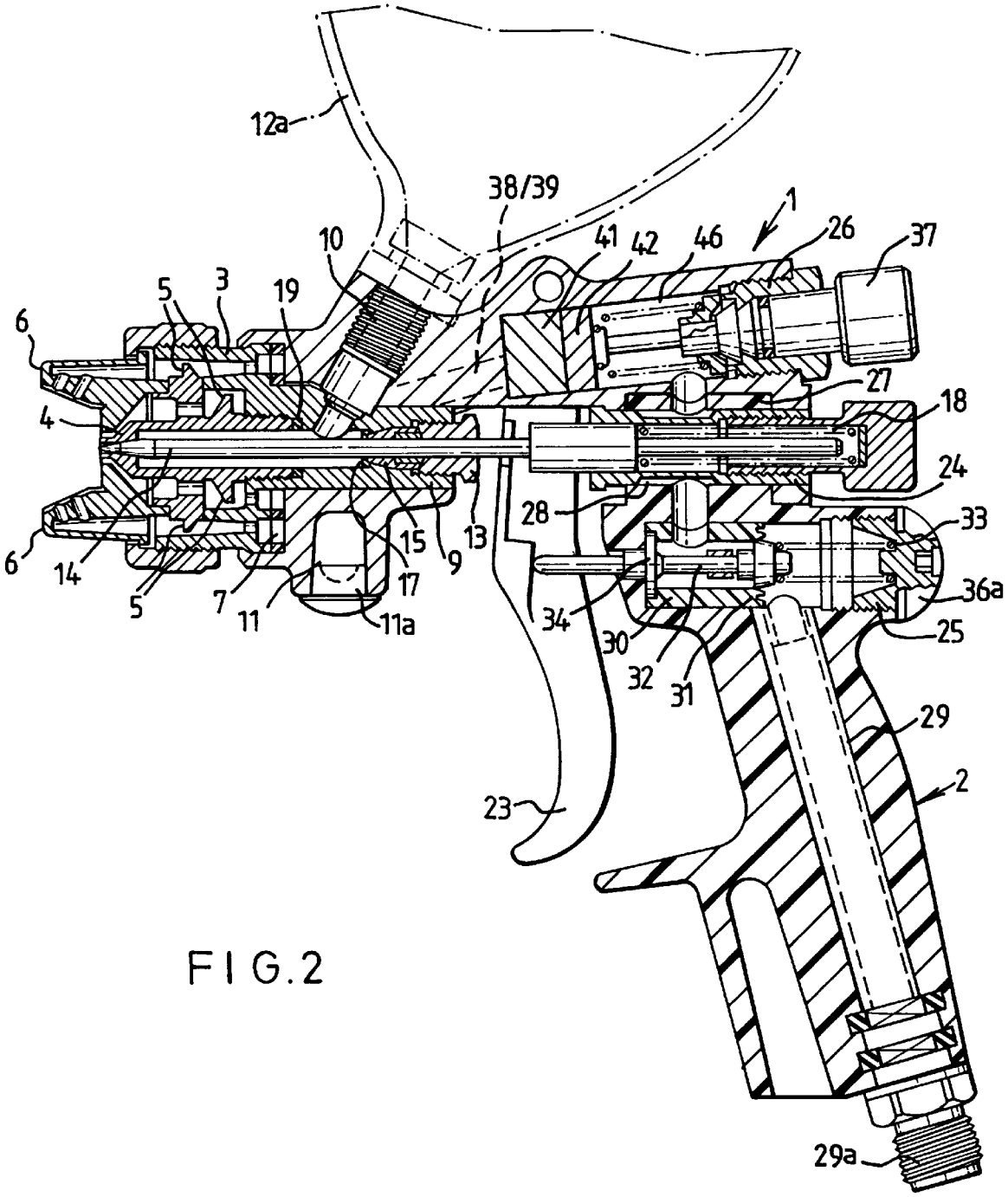
FIG. 2 is an axial section, similar to FIG. 1, of a gravity feed configuration of the improved spray gun.

A second embodiment of the spray gun is shown in FIG. 2, in which the fluid inlet 11 for a suction cup is closed off by a plug 11*a*. The inlet 10 is fitted with a gravity fed reservoir 12*a* to replace suction cup 12 of FIG. 1.

Figure 5:
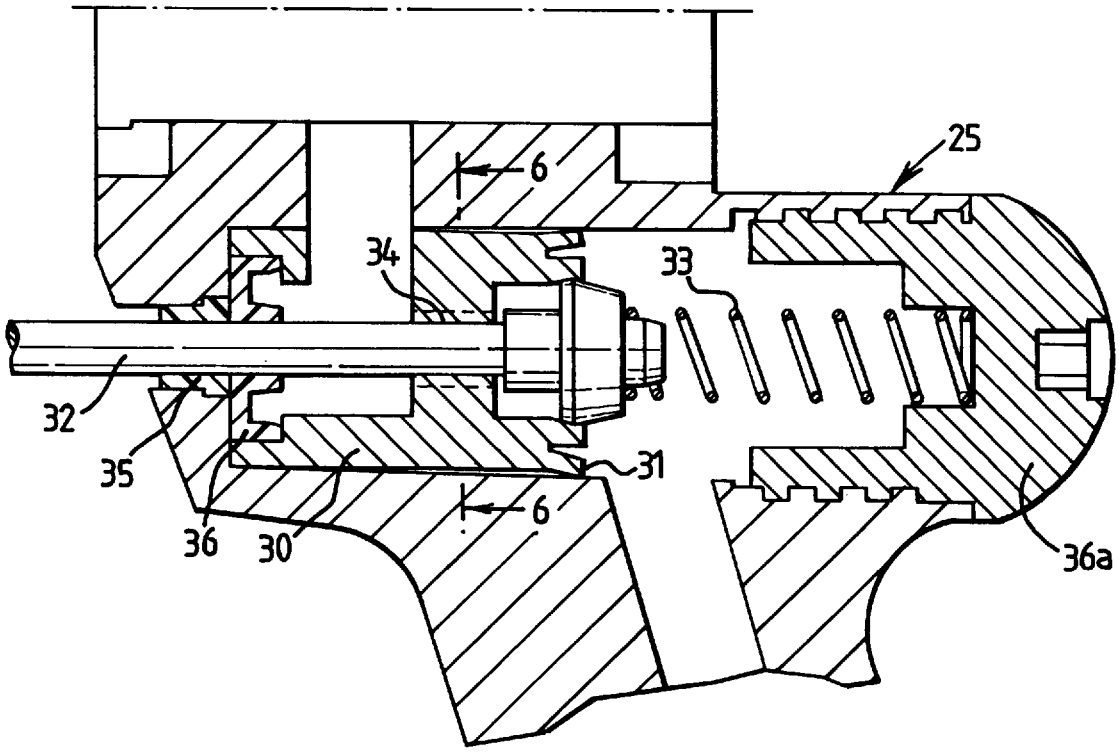
FIG. 5 is an enlarged cross-section of the air valve shown in FIGS. 1 and 2.
Figure 6:
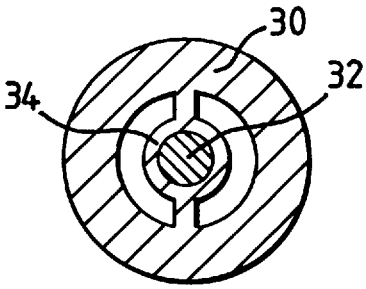
FIG. 6 is a cross-section taken along the line 6—6 of FIG. 5.

The air valve 25 illustrated in FIGS. 5 and 6 comprises an acetal plastics body 30 having a moulded lip seal 31 to prevent air by-passing the valve at its rear face to shut-off the air when a valve stem 32 is pushed forward by the pressure of an air valve spring 33. The shaft of the valve stem 32 is made of stainless steel and is supported in a moluded-in bearing 34 at the rear end of the acetal plastics body and by a PTFE bush 35 mounted in a bore at the front of the handle bore. Lubrication of the stem 32 is by transfer of the PTFE bush 35 during use.

A seal 36 is fitted into the front of the air valve body 30 to prevent escape of air to the atmosphere when the gun is in operation and the bore containing the air valve 25 is closed with a threaded plug 36*a*.

The air distributor control valve shown in FIGS. 3 and 4*a* to 4*c* is designed to control the balance of air being passed to the aircap so that an increase or decrease of the spray fan pattern size can be accomplished by varying the air port passing air to the fan control section of the aircap. The air supplied to the atomising section of the aircap is correspondingly reduced, maintaining the balance in the aircap and preventing excessive pressure rise in the atomising section.

The function of the air distributor control valve is to control two separate air supplies 38 and 39 (see FIG. 3) to the aircap via the spray head 3. By rotation of knob 37 the valve is capable of progressively shutting off the shaping air supply to the aircap horns 6 while, at the same time, reducing the flow of atomising air 38 to the centre of the aircap so that it is maintained at a reasonably constant pressure. A set pressure may be maintained for atomising air regardless of adjustments made to the spreader (shaping) air 39.

Figure 3:
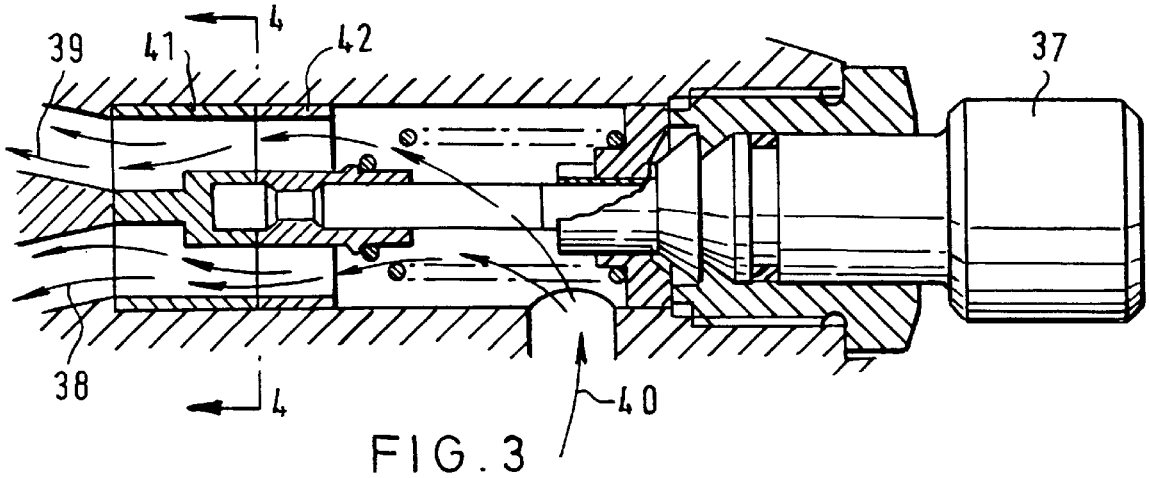
FIG. 3 is a fragmentary cross-section of an air distributor control valve illustrated in FIGS. 1 and 2.
Figures 4A, 4B, 4C, 4D, 4E:
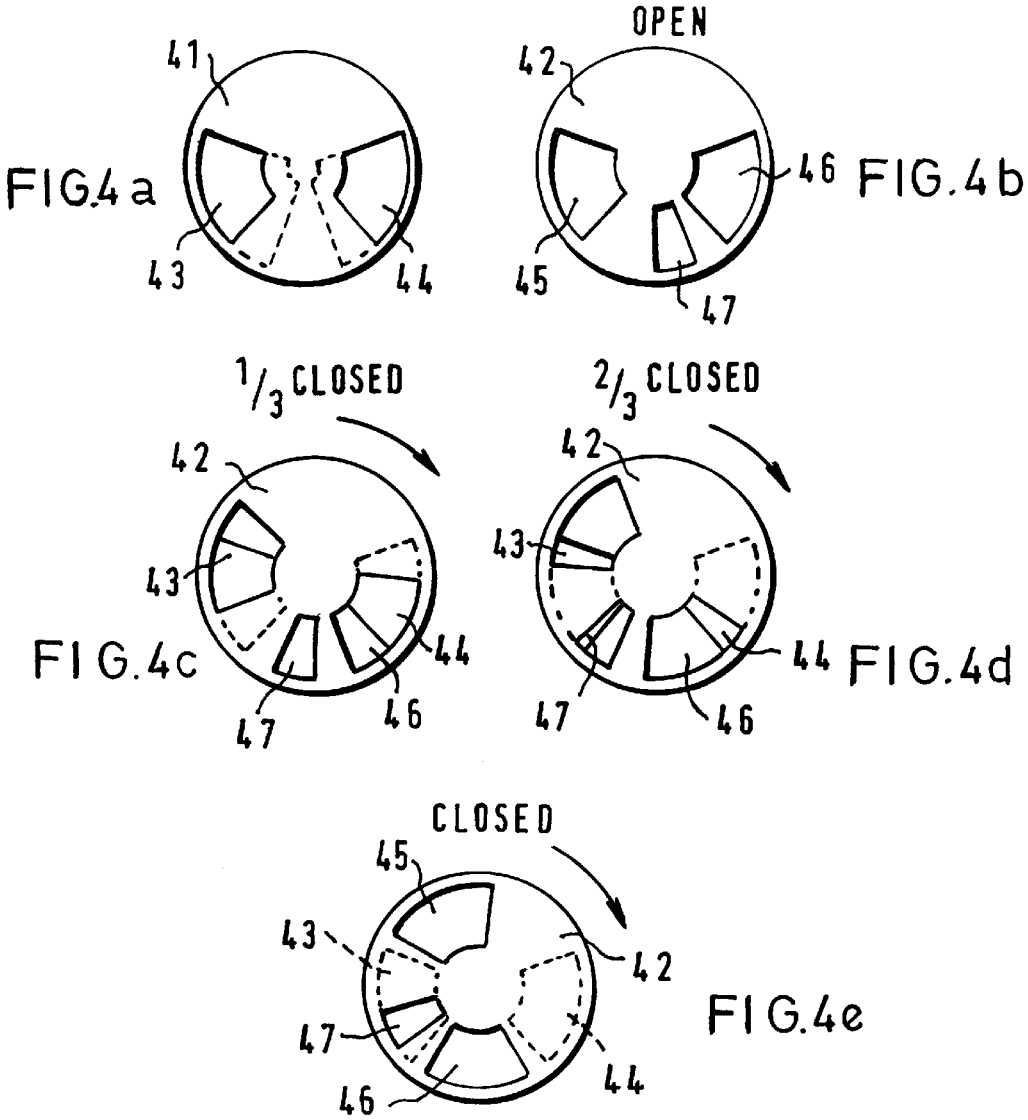
FIGS. 4*a* to 4*e* are cross-sections taken along the line 4—4 of FIG. 3, showing five different rotational adjustments of the air distributor control valve.

FIGS. 4*a* to 4*c* are cross-sections taken along the line 4—4 of FIG. 3 and show the progressive closing of the spreader valve.

Two plates 41 and 42 are located face to face inside the gun body 1 each plate having spaced radial apertures passing through it. Plate 41 has two spaced radial apertures 43 and 44 while plate 42 has three spaced radial apertures 45, 46 and 47. The holes are positioned in such a way that the cross-sectional areas, through which the supply air may pass are made variable by rotating one plate 42 relative to the other fixed plate 41.

In the fully open position, the holes 43 and 44 within the plates are aligned with holes 45 and 46 to give a maximum cross-sectional area. Supply air 40 is fed into the main chamber 46 and separated into atomising air shown by the arrows 38 and spreader air shown by the arrows 39, see FIG. 3, which feed the aircap as required.

The balance between the spreader and atomising air is maintained while the plate 42 is rotated (see FIG. 4*c*) until a third shaped hole 47 comes into play (see FIG. 4*c*) which enables the atomising air 38 to be maintained at a reasonably constant pressure, even when the spreader air 39 is completely shut off (see FIG. 4*e*).

The operation of the air distributor control valve will maintain the quality of the sprayed pattern and, in the case of high volume low pressure (HVLP) spray guns, it will control the pressure at the aircap within the various legislative settings.

Figure 7:
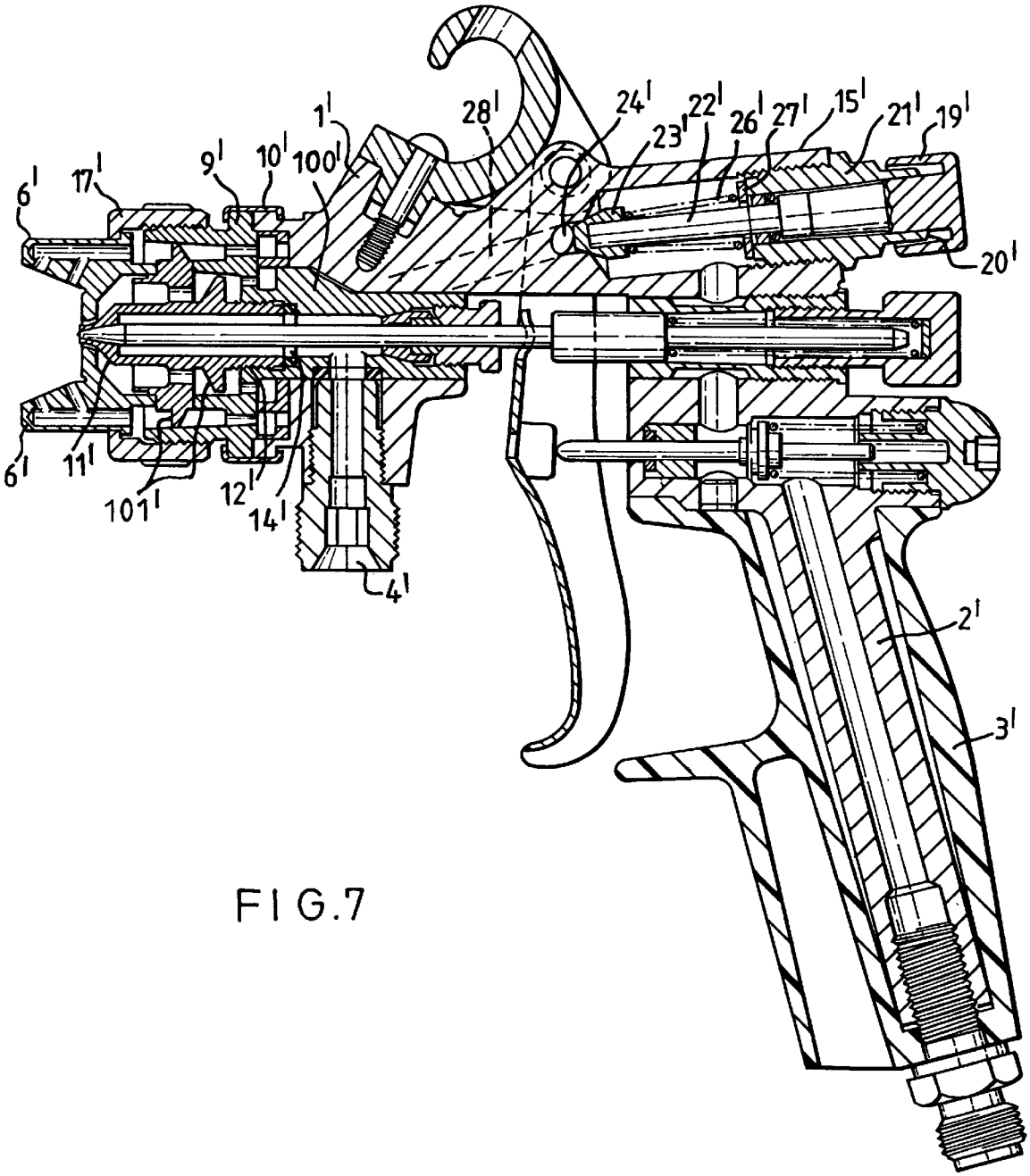
FIG. 7 is an axial cross-section of a second embodiment of the improved spray gun.

The third embodiment of a spray gun assembly shown in FIG. 7, comprises a ball-burnished diecast aluminium upper gun body 1', with a spigot 2' for a handle 3'. The handle is moulded from plastics material, e.g. polybutylene teraphthalate with 10% of a polyester elastomer. The plastics material may be coloured with a pigment to enable the spray gun to be printed with markings, i.e. the manufacturer's name, by laser markings.

The spray gun is machined for either suction feed at fluid inlet 4', or gravity feed at fluid inlet 5' (see FIG. 8) but these are alternatives and are not interchangeable. The body 1' is swaged to a sprayhead 9' by a ring 10' of stainless steel. A control spigot 100' moulded from glass-filled polyarylamide is retained in the gun head 9' during the assembly, and swaging of the ring 10'.

A nozzle 11' is screw threaded at 12' into the central spigot 100' made from glass filled polyarylamide and is tightened by a plastics tightening disc 13' moulded from acetal which is located on an odd number of flats on the front of nozzle 11'. A flexible seal 14', moulded from a low density polyethylene, is fitted between the nozzle 11' and the sprayhead 9' to provide a total fluid seal. The sprayhead may be moulded from a plastics material. An aircap 6' has a ball seating 7' connecting onto a conical surface 8' on the nozzle 11' and is retained by a retaining ring 17'.

Figure 8:
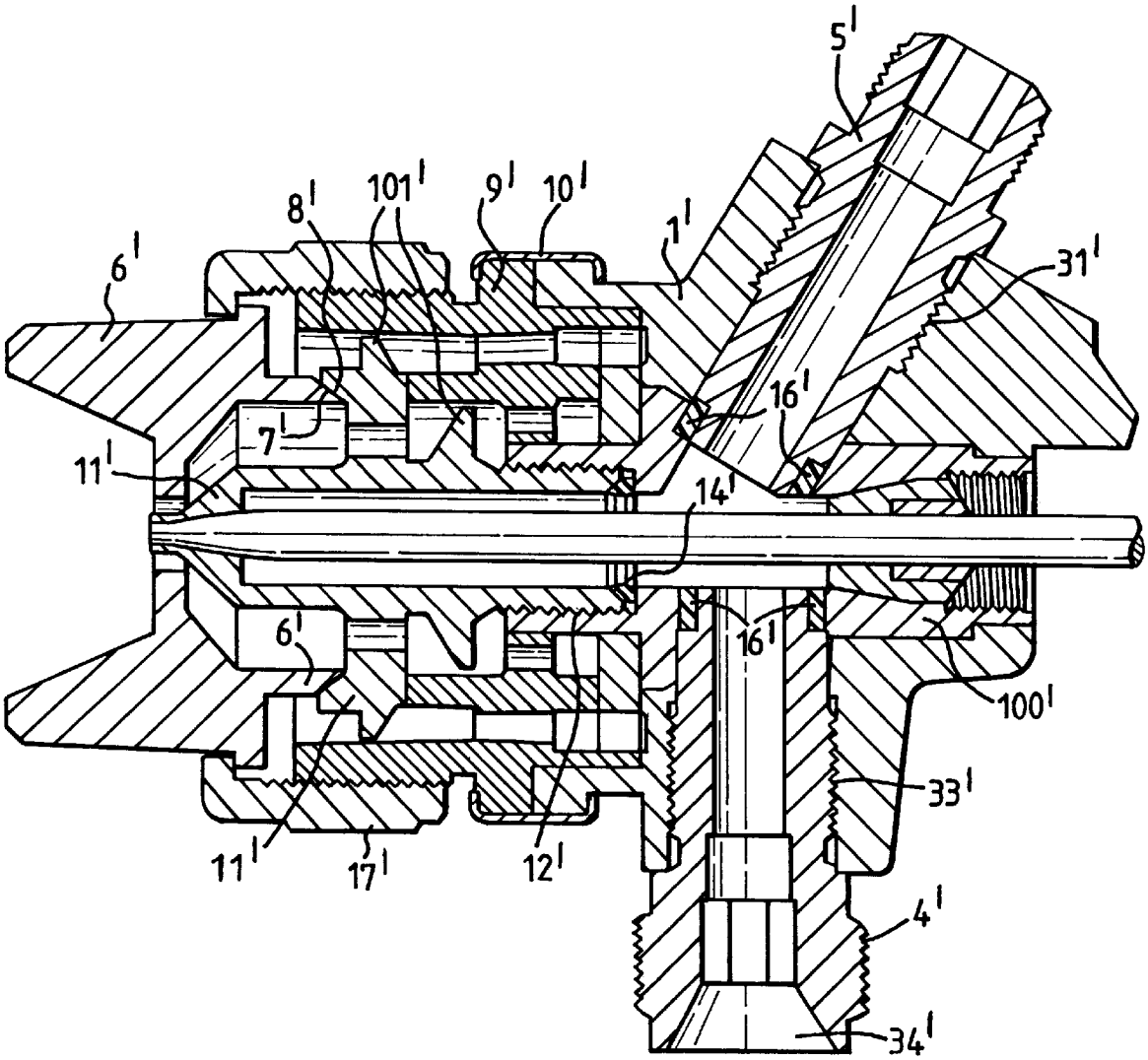
FIG. 8 is an enlarged axial cross-section of the front end of the spray gun of FIG. 7.

The gravity fluid inlet 5', see FIG. 8, in the gun body 1' is tightened, metal to metal, against the face of the gun body 1'. A polytetrafluorethylene seal 16' is compressed between the fluid inlet 5' and the spigot 100' to create an air- and fluid-tight joint, by forcing a tool in the fluid inlet and expanding the end of the inlet against the seal 16'.

The improved spray gun is available with either BSP fluid inlet 4' or NPS fluid inlet 5' air and fluid inlets. The air inlet 18' has either ¼" BSP or NPS threads and the fluid inlet, on the suction model, ⅜" BSP or NPS threads.

A baffle is created by weirs 101' on the profile of the nozzle 11' which co-operate with surrounding walls of the sprayhead 9' to control the evenness of the flow of the air to both atomising and fan sections of the aircap 6'.

Figure 13:
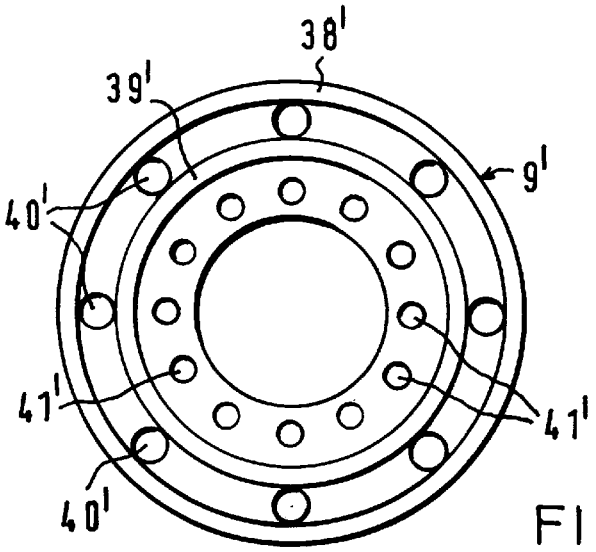
FIG. 13 is a cross-section taken along the line 14—14 of FIG. 9.
Figure 14:
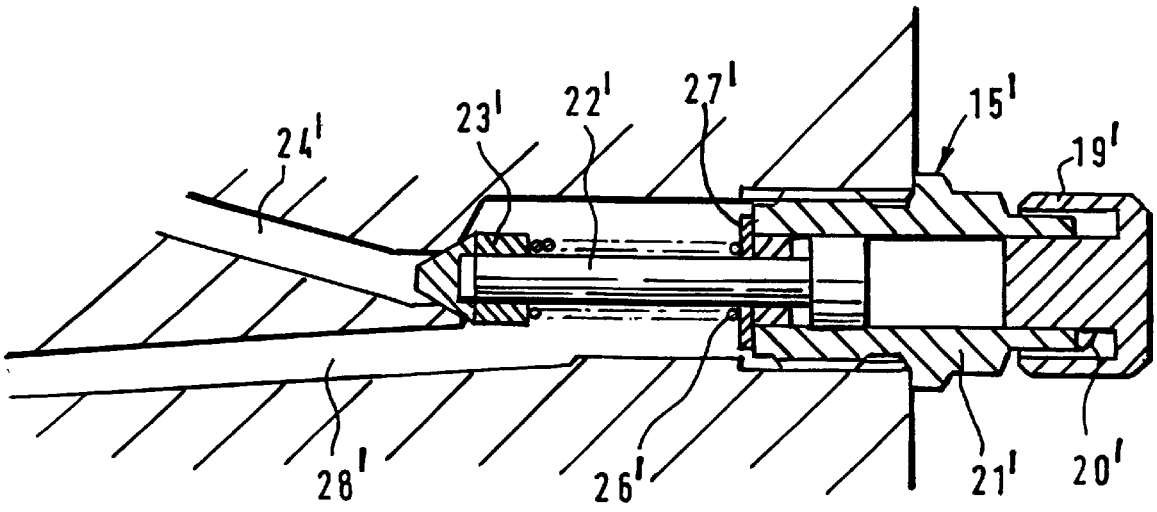
FIG. 14 is a cross-sectional detail of another version of the air distributor control valve.

The passage of the air is controlled by the spreader control valve 15', an enlarged detail of which is shown in FIG. 14. The valve comprises a control knob 19' which engages a cam face 20' on the valve body 21'. A spindle 22' passes through the valve body 21' with a valve head 23' at its free end. The valve head seals against a face leading to an air supply passage 24' connected with the sprayhead 9', see FIGS. 10 to 13. The cam face is held against the control knob 19' by the spring 26' located between the valve head 23' and a ring 27' located against the valve body 21'.

The function of the spreader control valve 15' is to control the separate air supply passage 24' to the aircap via the sprayhead 9'. The valve is capable of progressively shutting off the shaping air supply to the aircap 6'. The spray cam facilitates the controlled adjustment of the valve through a rotation of approximately 320°.

A gravity fluid inlet 5' and a suction fluid inlet 4' are illustrated in FIG. 8.

The inlet 5' is for gravity feed and has an external screwhead 31' which screws into the spray gun body and seals with the central spigot 100' by the seal 16' (see FIG. 8).

The alternative inlet 4' illustrated in FIG. 8 is similar to inlet 5' with an external screwthread 33' for screwing into the suction inlet of the spray gun body 1. However the main difference between the two is that the suction inlet has a tapered hole 34' at its outer end. The inlet is sealed in the suction inlet by a polytetrafluorethylene washer 16', (see FIG. 8) as hereinbefore described. Both inlets have an outer screw-thread projecting from the spray gun by which the fluid supply is connected to the spray gun.

Figure 9:
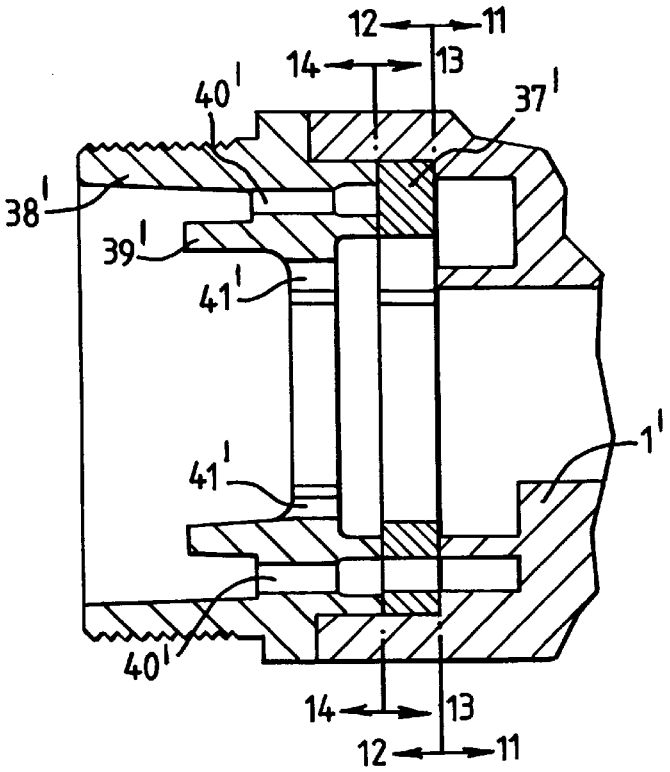
FIG. 9 is an axial cross-section of the head of the improved spray gun with the spigot removed showing a detail of the spray-head baffle.

An enlarged detail of the sprayhead 9' is shown in FIG. 9. The sprayhead is sealed with the spray gun body 1' by the stainless steel ring 10' with the interpositioning of a separator plate 37' moulded from acetal copolymer. The sprayhead 9' has two concentric annular collars 38' and 39' which co-operate with the nozzle weirs 101' to baffle the air flow to the nozzle 11' and aircap 6' (see FIGS. 7 and 8).

The air is directed along a sinuous path as illustrated in the four cross-sectional views along the lines 11—11, 12—12, 13—13 and 14—14 of FIG. 9.

Figure 10:
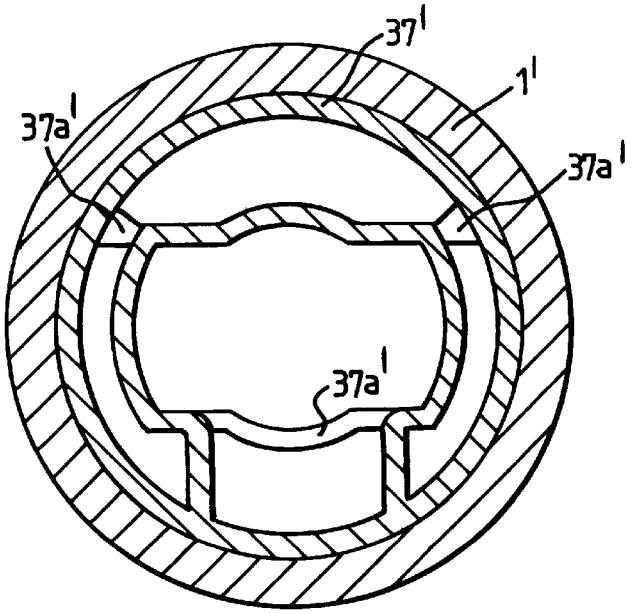
FIG. 10 is a cross-section taken along the line 11—11 of FIG. 9.

FIG. 10 shows a cross-section of the gun body 1 taken along the section line 11—11 of FIG. 9 with a section of the separator plate 37' with passages 37*a'* leading to the spray gun nozzle 11'.

Figure 11:
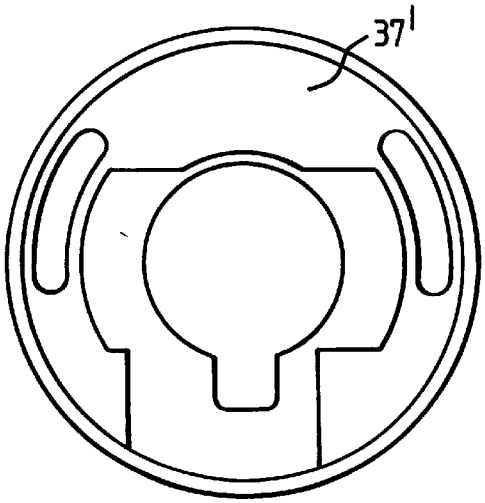
FIG. 11 is a cross-section taken along the line 12—12 of FIG. 9.

FIG. 11 shows a cross-section of the separator plate 37' when viewed in the direction of the section line 12—12 of FIG. 9 from the gun body side.

Figure 12:
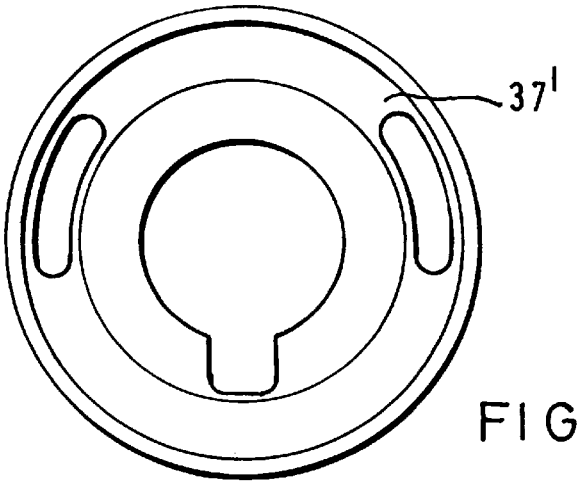
FIG. 12 is a cross-section taken along the line 13—13 of FIG. 9.

FIG. 12 shows a cross-section taken along the line 13—13 of FIG. 9 of the separator plate 37' when viewed from the baffle side.

FIG. 13 is a cross-section of FIG. 9, taken along the line 14—14 of the back face of the baffle plate 37'. The annular recess between the collars 38' and 39' has a series of radial holes 40' as well as a series of radial holes 41' inside the inner collar 39'.

Figure 15:
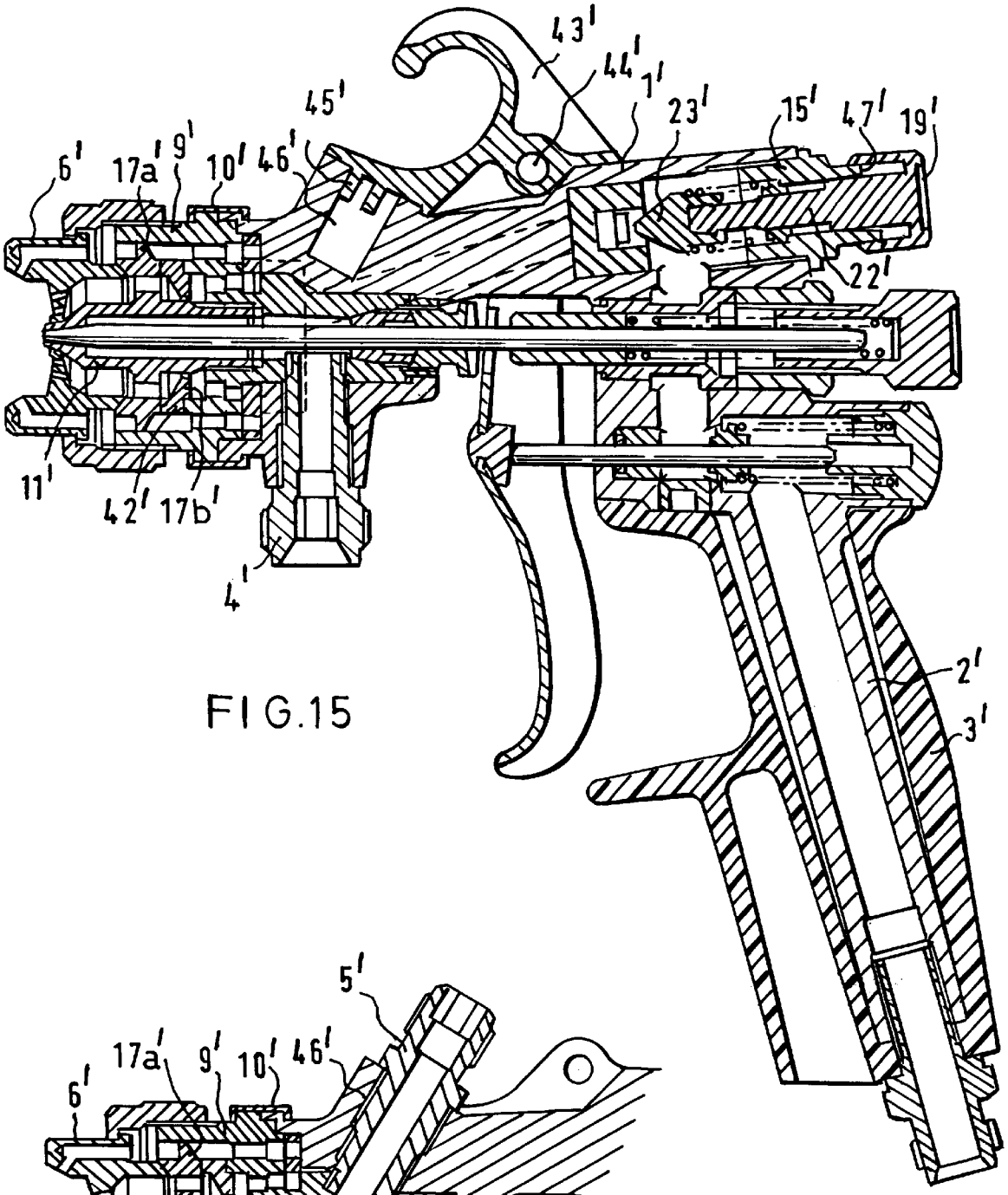
FIG. 15 is an axial cross-section of a second embodiment of the improved suction spray gun.
Figure 16:
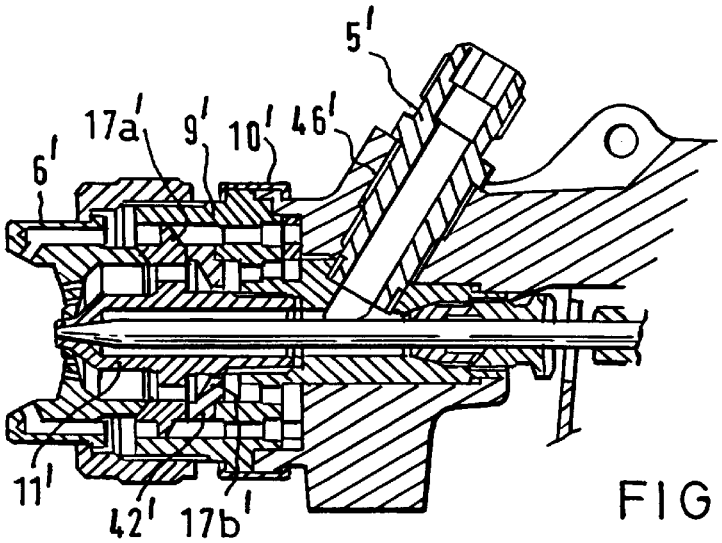
FIG. 16 is a fragmentary axial cross-section of a gravity spray gun.

In the fourth embodiment of the spray gun shown in FIGS. 15 and 16, like parts have the same reference numerals as the third embodiment. In the fourth embodiment, the spray head 9' has a different configuration in which the weirs are formed by two separate components, the nozzle 11' with weir 101'*a* and a separate ring member 42' forming a second weir 101*b*. This construction enables the nozzle 11' and aircap 6' to the more easily assembled.

Another variation compared with that of the third embodiment is the construction of the hook 43'. This is secured to the gun body 1 by a pin 44' and is located by projection 45' which engage the hole 46' adapted to receive the gravity feed fluid inlet 5' (see FIG. 16).

Figure 17:
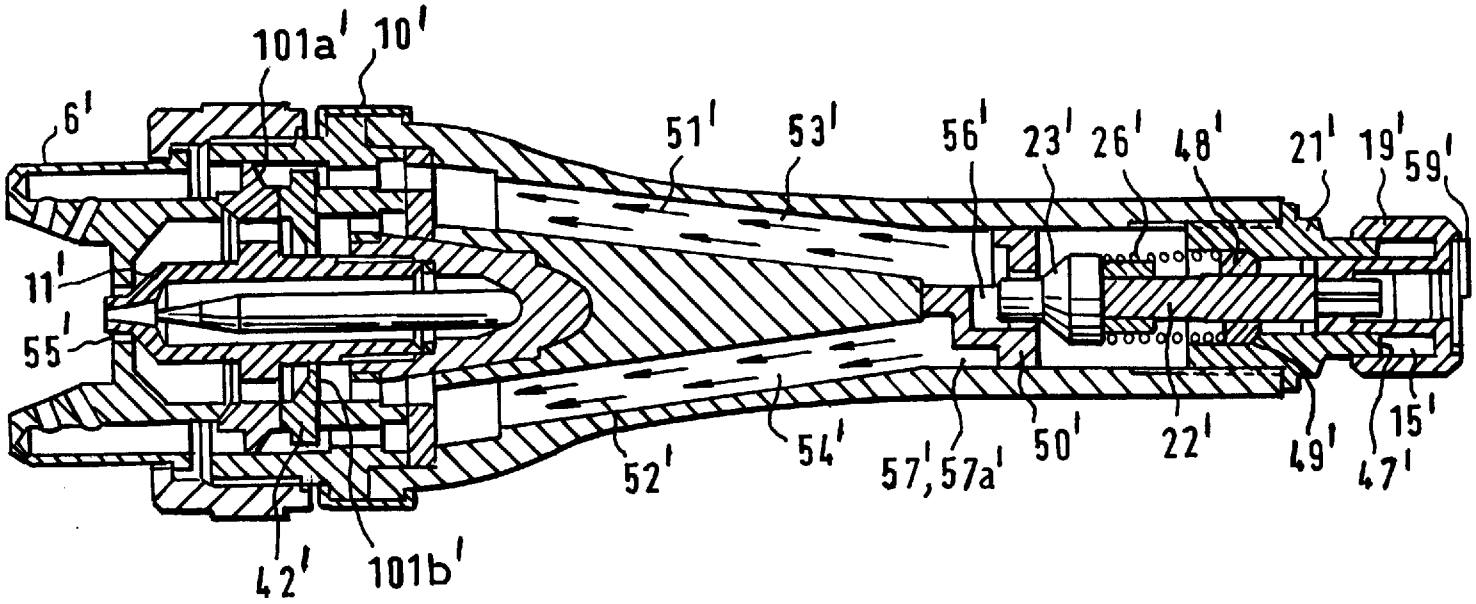
FIG. 17 is an axial cross-section of a detail of the nozzle of the spray gun and a further version of the air distributor control valve.

The major difference in the fourth embodiment is in the construction of the spreader control valve 15', an enlarged detail of which is shown in FIG. 17. The spreader control valve 15' is adjustable by a control knob 19' which engages the cam face 47' on the valve body 21'. The control knob 19' is moulded from acetal copolymer and is snap-fitted to spindle 22' the remote end of which is formed into a valve head 23'. The valve spindle is encircled by a coil compression spring 26 located between the valve head 23' and a ring 48' located against a shoulder 49 formed in the valve body 21'. The pointed end of the valve head 23' engages a spreader separating moulding 50' enlarged details of which are shown in FIGS. 18 to 20.

A filler piece 59' has a small diameter shaft, integrally moulded with the filler piece 59', which enters the hollow end of spindle 22' and prevents the knob 19' from being removed. It also snap-fits into the knob 19'.

The shape of the moulding 50' provides paths for the fan air 51' and the atomised air 52'. The fan air flows along a channel 53' to the weir 101'*a* on nozzle 11' and exits from the aircap horns, while the atomised air 52' passes along the channel 54' through weir 101'*b* created between ring member 42' surrounding nozzle 11' and exits from the central aperture 55' encircling the nozzle.

Figure 18:
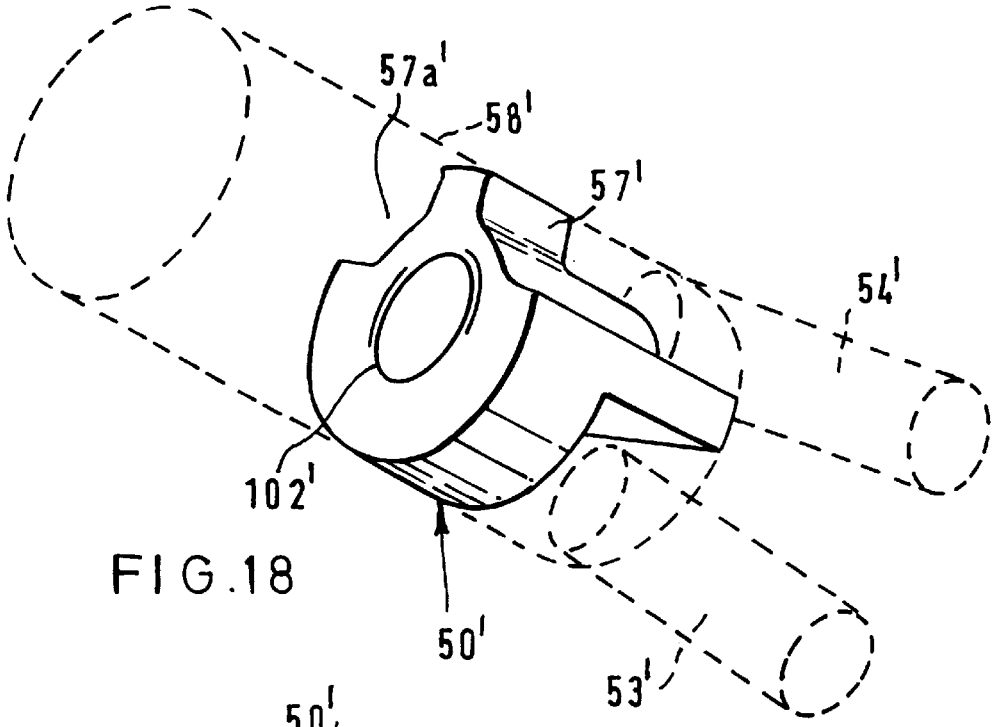
FIGS. 18 to 20 are respectively, a diagrammatic perspective view, a side elevation and a front elevation respectively of a spreader separator moulding, shown in FIG. 17.
Figure 19:
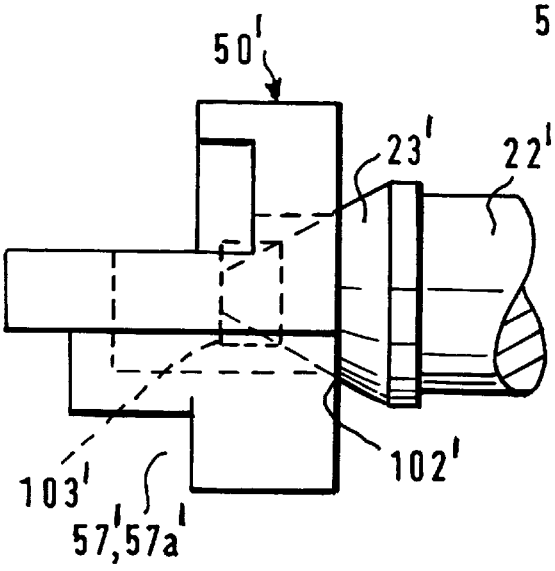
Figure 20:
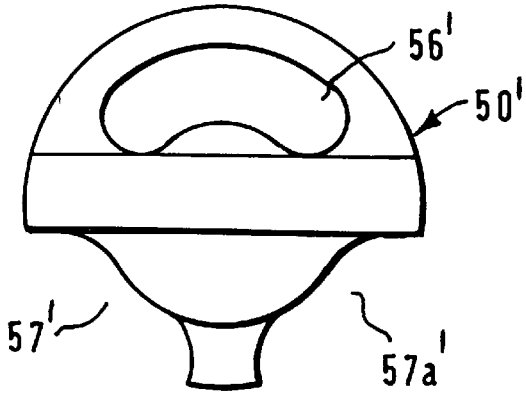

The spreader separator moulding 50' illustrated in detail in FIGS. 18 to 20 receives fan air through the central aperture 102' and flows through arcuate recess 56' then along the channel 53' while the atomising air enters two arcuate apertures 57' and 57'*a* formed between the moulding 50' and the wall of the spreader control valve passage 58' in which the valve is mounted. By adjusting the spreader control valve knob 19' against its cam face 47' the valve head 23' is spaced from the moulding 50' to control the flow of the fan air to the air cap.

The parallel section 103' of the valve head 23' in co-operation with the central aperture 102' allows more progressive control of the fan air without the need to maintain close dimensional control of the mating parts.

Although described for use with a hand held spray gun it will be apparent that the invention can also be incorporated in automnatic, i.e., other than hand held lightweight spray-guns.

We claim:

1. A spray gun comprising an aluminum gun body, and a sprayhead made of a plastics material permanently secured to said gun body.

2. A spray gun, as set forth in claim 1, and wherein said sprayhead is permanently secured to said gun body by a swaged metal ring.

3. A spray gun, as set forth in claim 1, and wherein said metal ring is of stainless steel.

4. A spray gun, as set forth in claim 1, and wherein said sprayhead is permanently secured to said gun body by an end of said gun body which is swaged over an outer portion off said sprayhead.

5. A spray gun, as set forth in claim 4, and wherein said gun body is of die cast aluminum.

6. A spray gun, as set forth in claim 1, and wherein said spray gun has a handle made from polybutylene with 10% of a polyester elastomer.

7. A spray gun, as set forth in claim 6, and wherein said spray gun handle includes a colored pigment suitable for markings with a laser.

8. A spray gun, as set forth in claim 1, and wherein said spray gun has an air body includes a passage adapted to deliver pressurized air to said sprayhead, and further including a nozzle secured to said sprayhead, said nozzle having weirs which cooperate with said sprayhead to baffle a flow of air through said spray gun.

9. A spray gun, as set forth in claim 1, and wherein said body has a top aperture adapted for receiving coating fluid through gravity feed and a bottom aperture adapted for receiving coating fluid through suction feed, wherein said sprayhead has a spigot defining a coating fluid inlet which aligns with said top aperture when said sprayhead is secured to said gun body in a first position and which aligns with said bottom aperture when said sprayhead is secured to said gun body in a second position.

10. A spray gun, as set forth in claim 1, and further including an air cap attached to said sprayhead, an air distributor control valve including a fixed member having first radial apertures and a rotatable member having second radial apertures axially aligned and rotatable relative to said fixed member, said valve being mounted in the path of supplies of atomization air and pattern shaping air to said cap, and wherein rotation of said rotatable member progressively closes said radial apertures to shut off a flow of pattern shaping air to said air cap while simultaneously reducing a flow of atomizing air to said air cap to maintain a constant atomizing air pressure at said air cap.

11. A spray gun, as set forth in claim 10, and wherein said fixed and rotatable members are abutting apertured plates located in said spray gun body.

12. A spray gun comprising an aluminum gun body, and a sprayhead made of a plastics material permanently secured to said gun body, and wherein said sprayhead is of a hard plastics material, and further including a molding of a plastics material softer than said hard plastics material of said sprayhead, wherein said molding is clamped between said sprayhead and said gun body, said molding having faces with deformed beads which seal to said spray gun body and to said sprayhead.

13. A spray gun, as set forth in claim 12, and wherein said sprayhead is of polybutylene terephthalate and said molding is of acetal copolymer.

14. A spray gun, as set forth in claim 3, and wherein said spray gun has a handle made from polybutylene with 10% of a polyester elastomer.

15. A spray gun comprising an aluminum gun body, and a sprayhead made of a plastics material permanently secured to said gun body, wherein said body has a top aperture adapted for receiving coating fluid through gravity feed and a bottom aperture adapted for receiving coating fluid through suction feed, wherein said sprayhead has a spigot defining a coating fluid inlet which aligns with said top aperture when said sprayhead is secured to said gun body in a first position and which aligns with said bottom aperture when said sprayhead is secured to said gun body in a second position, and further including a hook adapted to support said spray gun, and means for securing said hook in said top aperture when said sprayhead is secured to said gun body in said second position.

* * * * *